United States Patent [19]

Pitre

[11] 4,031,318

[45] June 21, 1977

[54] HIGH FIDELITY LOUDSPEAKER SYSTEM

[75] Inventor: Lester M. Pitre, Orleans Parish, La.

[73] Assignee: Innovative Electronics, Inc., Jefferson, La.

[22] Filed: Nov. 21, 1975

[21] Appl. No.: 634,239

[52] U.S. Cl. ..... 179/1 D; 179/1 E; 181/145; 181/146; 181/147; 181/148; 181/155

[51] Int. Cl.[2] ..... H04R 1/02; H04R 1/20; H04R 3/12

[58] Field of Search ..... 179/1 E, 1 GA, 1 D; 181/144, 145, 146, 147, 148, 149, 150, 151, 152, 153, 154, 155, 156, 175, 177, 178, 179, 191, 195, 196, 197, 199; 333/28 R, 28 T

[56] References Cited

UNITED STATES PATENTS

| | | | |
|---|---|---|---|
| 2,373,692 | 4/1945 | Klipsch | 181/152 |
| 3,637,039 | 1/1972 | Raichel et al. | 181/146 |

FOREIGN PATENTS OR APPLICATIONS

| | | | |
|---|---|---|---|
| 44-32450 | 12/1969 | Japan | 179/1 E |
| 1,244,751 | 9/1971 | United Kingdom | 179/1 E |

*Primary Examiner*—George G. Stellar
*Attorney, Agent, or Firm*—Pugh & Keaty

[57] ABSTRACT

A high fidelity loudspeaker system involving a multi-driver, semi-omnidirectional, full range, electrodynamic loudspeaker including two, separate but complementary, closed box-like enclosures, an upper unit containing an array of mid-range speakers around three sides and a lower unit containing arrays of low and high frequency speakers around three sides. The low frequency speakers (woofers) on their interior sides include a series of tubes opening into the closed interior of the speaker enclosure, having various lengths in accordance with certain relative, locational relationships. Although the low and high frequency speakers include a single crossover frequency circuit, the "mid-range" speakers are not included in any crossover network but are driven throughout the total frequency input range, although a capacitor can be included to cut off the very low frequencies to the mid-range speakers. The number of speakers in the arrays in each unit can be varied, but in the lower unit the over-all speaker panel sizes remain the same with the speaker locations on each panel being made asymmetrical about the horizontal center-line, allowing for alternative, up-or-down placement. A protective outer case about the cabinet can be included having hinged wall sections, which also serve when opened out as reflective surfaces, providing a "built-in corner" (FIG. 10). For easy mobility, a handle and rollers can be provided on the back of the unit (FIG. 9). Terminal strip and electrical hook-ups are provided on the exterior of the speaker allowing flexible application and use (FIGS. 7–7C).

11 Claims, 17 Drawing Figures

HIGH FIDELITY LOUDSPEAKER SYSTEM

BACKGROUND OF THE INVENTION

1. Field of the Invention

The present invention relates to a high fidelity loudspeaker system including a multi-driver, electrodynamic loudspeaker designed for consumer and commercial use.

2. General Background

The two largest problems of the electrodynamic loudspeakers of the prior art are, firstly, one driver is unable to reproduce accurately both low and high frequencies, and secondly, as the input power is increased, the distortion rises as well. Both problems stem primarily from the physical limitations of the speaker cone.

In order to be able to reproduce low frequencies, the driver needs the ability to move large amounts of air. In contrast, high frequency reproduction requires very rapid movements of the cone, with much less actual air moving capacity. Large air movement requires the cone either to be very large or move large distances. Movement of the cone (cone excursion) in large amounts, introduces distortion because a cone near its full extension will be unable to reproduce another transient at the same time. So, in order to lower the cone excursion and retain large air movement, the area of the cone is increased. Consequently, when the cone area is increased, so is the mass of the cone. This increase in mass also prevents the cone from traveling properly at the high frequencies of the audio band. The answer to this problem could be simple; viz., separate the audio band into two smaller bands of low and high frequencies, each driving a separate woofer or tweeter, respectively. However, the large woofer lacks adequate transient response in the low frequencies as well as any frequency extending above that point. Although efficient, it requires the use of an enclosure, which because of the interaction of the driver and the cabinet, is tuned to a particular frequency. This is done to increase the overall bass output of the loudspeaker.

Another method of obtaining large cone area is to use the combined effect of several smaller woofers. This offers several advantages, such as: several magnet assemblies (higher efficiency) rather than one large unit, lighter cones for better transient response, and each speaker receives less power and consequently produces less distortion. The concept of multiple-drivers is not new, but because of the inherent phasing and resonance problems of such arrays, their use has been limited.

3. Prior Art

The best prior art known to applicant from a search in the U.S. Patent Office files is listed below -

| Patentee | U.S. Pats. Pat. No. | Issue Date |
|---|---|---|
| L. S. Doubt | 2,602,860 | July 8, 1952 |
| J. E. Parker | 2,632,055 | March 17, 1953 |
| J. D. Hoffman | 2,872,516 | February 3, 1959 |
| A. G. Bose | 2,915,588 | December 1, 1959 |
| M. L. Berry | 3,052,758 | September 4, 1962 |
| D. Manicri | 3,241,631 | March 22, 1966 |
| A. G. Bose | 3,582,553 | June 1, 1971 |
| K. De Boer | 2,610,694 | September 16, 1952 |
| F. W. Nichols | 3,627,948 | December 14, 1971 |
| H. Ekdahl, et al. | 3,670,842 | June 20, 1972 |
| D. Huszty, et al. | 3,862,366 | January 21, 1975 |

| "Audio" Magazine Publications | | | |
|---|---|---|---|
| Date | Pages | Article(s) | P.T.O. Class-Subclass |
| November, 1960 | pp. 20, 21 and 77–81 | "Matrixing" and "Sound System" | 179-1.GA |
| November, 1960 | pp. 54, 55 and 99, 100 | "The Series-Parallel Speaker Array" | 179-1.GA |
| December, 1962 | pp. 19–22 | "Word on Multiple Speakers" | 179-1.GA |

GENERAL DISCUSSION OF THE PRESENT INVENTION

The loudspeaker of the present invention overcomes these problems and introduces separate arrays for the low and high frequency bands. The low frequency array and the unique decoupling networks are not tuned to a particular frequency. The high frequency array, because of its unique arrangement, offers excellent dispersion and phasing characteristics. These two arrays are combined in a bottom or lower unit in the preferred embodiment of the present invention. In addition, the preferred embodiment of the loudspeaker of the present invention incorporates a separate, full range multi-driver array, designed specifically for mid-range use which in the preferred embodiment is included in a top or upper unit.

The preferred embodiment of the loudspeaker of the present invention incorporates several unique principles, among which are:

1. The use of separate low and high frequency multi-driver arrays, which because of their design, overcome the inherent resonance and phasing problems of loudspeakers.

2. The development of two separate and complementary loudspeaker enclosures to exhibit full range capacity.

3. The use of a three-sided, semi-omnidirectional radiation pattern, which effectively recreates realistic sound panorama, while retaining excellent directionality.

4. The use of a simplified wiring terminal, which allows for maximum flexibility in hookup of the loudspeader for any required usage.

5. The design of a commercial packaging arrangement which allows the use of the loudspeaker in rugged unsuitable environments, while retaining its excellent acoustic properties.

6. The use of a unique, consumer oriented construction, to provide maximum flexibility and acoustic performance through all embodiments including the lower priced versions.

Instead of making some improvements in contemporary design, an ideal model of what a perfect loudspeaker should be was designed, and this was used for a goal in the design of the loudspeaker of the present invention.

The ideal loudspeaker would have the following characteristics: It would have a frequency response that overlapped the input response of the ear; that is a response from about 10 Hz to about 25 kHz. It would have this frequency response with minimal differences in output. It would have proper acoustic coupling to the room. It would be able to reproduce the natural reverberation fields and sound panorama of live music. It would have to have the dynamic range of live music (120 db). Its transient response would have to be perfect. And finally, it would have to have resistance to acoustic feedback.

The loudspeaker of the present invention was designed to come as close as possible to the performance of the ideal model, while still using driver components that are readily available on the market. Thus the present invention does not require the manufacture of any specialized device but rather utilizes present technology. The unit also has to have a maximum amount of flexibility, both in its ability to be used in any type of application, and that the same design may be applied to a lesser model and still maintain as many of the superior characteristics of the large model, yet offer an economical compromise.

The present system achieves balanced quasi-omnidirectional radiation, such balance occuring through equal energy radiation from each of the three operative radiating planes of the loudspeaker, and on each such plane equal attention is given to each band of the entire frequency spectrum. This is achieved by an equal number of speakers identically arrayed on each panel.

Although, broadly speaking, multi-driver speaker systems, scattering resonances, accessory speaker enclosures, omnidirectional radiation pattern for corner speaker placement, and built-in hinged sound reflective surfaces are individually known in loudspeaker designs of the prior art, these concepts are uniquely applied in combination in the present invention as generally outlined below.

Multiple Drivers & Anti-Resonance Decoupling

In the present invention advantage is taken of having independently different driver elements to individually tune to a different resonant frequency achieved inter alia by:

1. Different physical location in cabinet;
2. Use of different lengths of tube behind the driver component to individually tune the drivers to a different resonant point;
3. The overall resonant frequency is the product of the drivers and its relationship to its enclosure; and
4. The resonance is scattered by using different mass cones;

which produce the following results:

1. No overall resonant point in the low frequency range allowing placement of cabinet in corner of room; and
2. This along with "phantom woofer effect" allows the design of a system which is not resonant dependent - a. Allows use of considerably lighter cones to get bass response; and b. Extends low frequency to inaudibility because no dependency upon a resonant point for bass response.

COMPLEMENTARY ENCLOSURES

In the present invention in the use of separate but complementary enclosures, a three way system is used with only one crossover point by:

1. Operating the woofers and tweeters as a 2-way system; and
2. Operating the complementary mid-range at full range with no crossover point with only the low frequency cut off by a capacitor;

producing the following advantages:

1. 3-way system with only one crossover point;
2. While one system is being crossed over, it is being complemented by one which has no crossover and greatly improves the acoustic appearance of the existing crossover in the other system;
3. Being separate allows for consumer flexibility:

a. Unit may be purchased separately; and b. Unit may be physically separated — increasing sound panorama;

4. More drivers operating in the room with all the advantages thereof — less distortion, more power handling capacity, etc.;
5. Upper section drivers (mid-range) need not be anti-resonant decoupled because operating above resonance point;
6. Upper section can be used separately as an independent full range system; and 7. If upper section is used as a "full range" unit, it will suffer intermodulation distortion but this is reduced due to elimination of low frequency.

BALANCED QUASI-OMNIDIRECTIONAL RADIATION

The balanced, 3-directional system of the present invention involves:

1. Flat amplitude linearity — can be placed in corner;
2. No drivers on the rear panel — so no lost energy in the corner;
3. Use of 66% reflective, 33% direct firing — most closely recreates the reverberant fields of live music;
4. Design allows the placement of the loudspeaker in corner of room, the most efficient placement, thus requiring less amplifier power;
5. The most effective and efficient use of panel surface area to mount drivers; and
6. Speaker can be moved in and out from wall to a. Control amount of bass coupling; and b. Control amount of panorama (closer to corner, the smaller it sounds, further from corner, the bigger it sounds).

BUILT-IN REFLECTOR SURFACES

In the present invention, the walls serve both as a protective casing when closed as well as diagonally disposed reflective surfaces when locked open, the reflective surfaces on both sides serving to simulate a "built-in corner".

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 7 is a generalized, schematic illustration of the preferred embodiment of the speaker hook-up of the present invention for the lower, woofer-tweeter speaker arrays, while

FIG. 10 is a plan view of the lower speaker unit with a hinged, outer, protective case added to the cabinet which can be folded out to a locked, diagonal disposition to form a "built-in-corner" arrangement for the loudspeaker, with some of the various beginning, interim and final positions of the walls of the case phantom-lined in.

DETAILED DESCRIPTION OF THE PREFERRED EMBODIMENT

Figure 1:
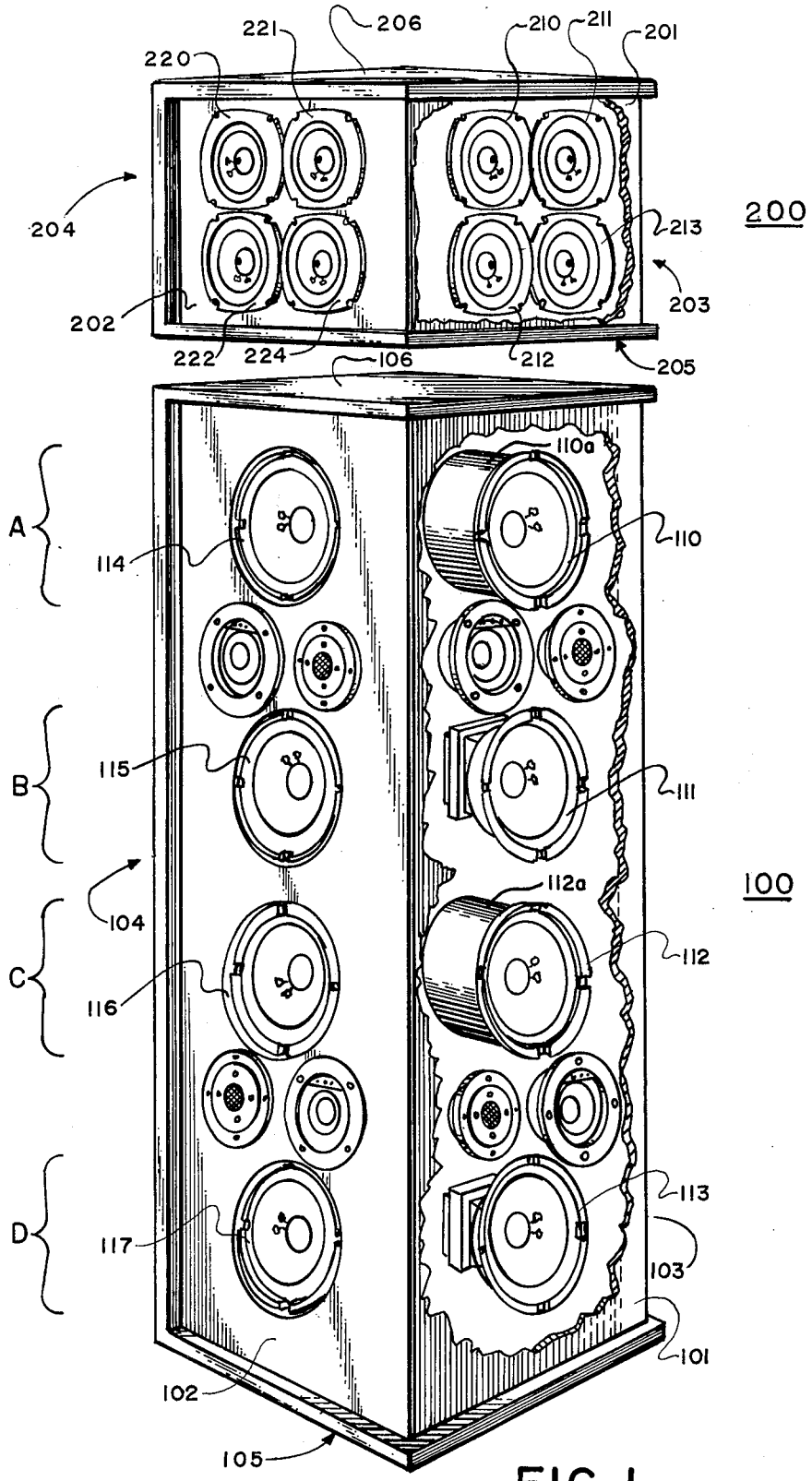
FIG. 1 is an exploded, perspective view of the preferred embodiment of the complete loudspeaker of the present invention, with the upper, mid-range cabinet exploded up off the lower woofer-tweeter cabinet, and with the center, front panel of each partially cut-away to show the individual speaker structures of the panels.
Figure 3A:
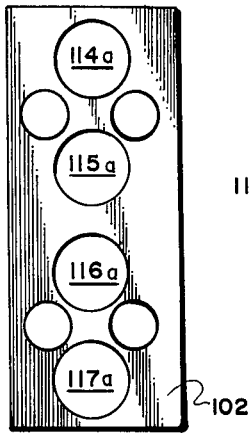
FIGS. 2A, 2B and 3A, 3B and 4A, 4B are front and sides views, respectively, of the center panel, the left-side panel, and the right-side panel, respectively of the lower woofer-tweeter cabinet of FIG. 1.
Figure 3B:
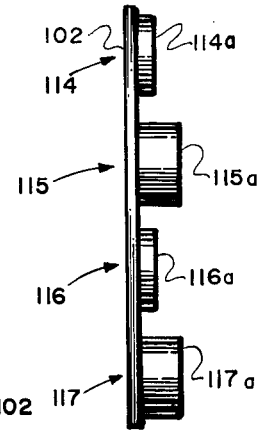
Figure 2A:
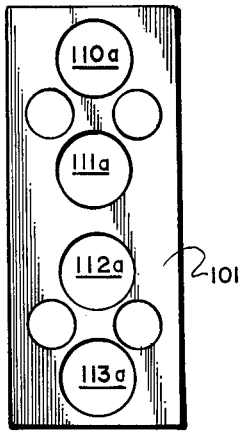
Figure 2B:
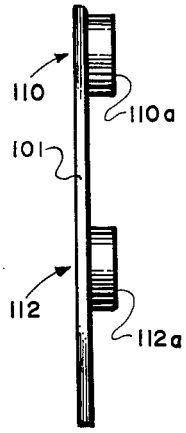
Figure 4A:
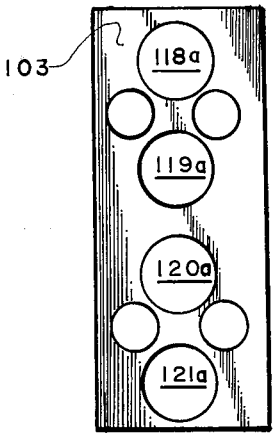
Figure 4B:
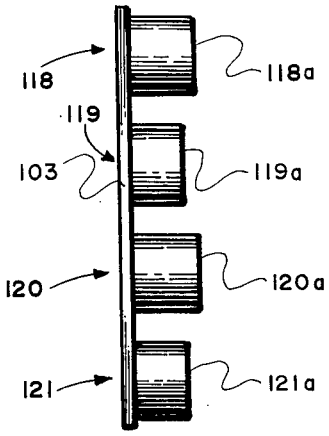
Figure 5:
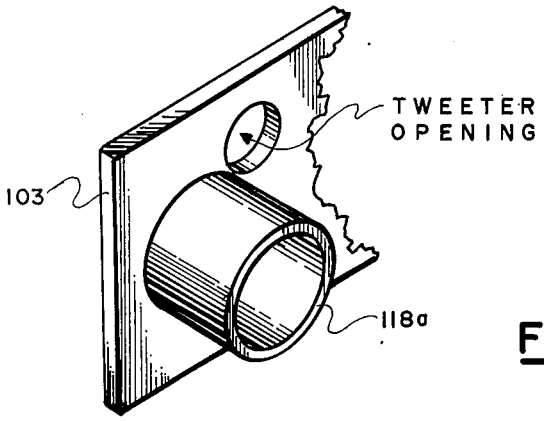
FIG. 5 is an isometric, partial view of the upper end of the right-side panel (on its side) of FIG. 4A–4B.

As best seen in the exploded view of FIG. 1, the preferred embodiment of the loudspeaker of the present invention includes two, separate, complementary speaker units or enclosures, a lower or bottom unit 100 and an upper or top unit 200. The two speaker units 100, 200 include three operative sides — a front speaker panel 101, 201, flanked by two side speaker panels 102–103, 202–203, respectively, the exteriors of the three speaker panels 101–103, 201–203 being substantially identical. As will be explained in greater detail below, the low and high frequency speaker arrays (woofers 110–121 and tweeters) are included in the lower unit 100, while the mid-range frequency speaker array is included in the upper unit 200. To complete the air-tight enclosures, each unit 100, 200 further of course includes back, bottom and top panels 104–106, 204–206, respectively, which do not include any speaker elements.

The cabinet is constructed so that each side is identical to the other from the line drawn horizontally through the panels. The speakers in row "A" (114, 110 & 118) have the same relative position in the cabinet as the speakers in row "D" (117, 113 & 121), both being at the extreme ends of the cabinet. The speakers in row "B" (114, 111 & 119) are mirrors of row "C" (116, 112 & 120). Because these six speakers in row A and D are in the same relative working position inside the sealed air column internal to the cabinet, they would usually act in unison to resonate very close to the same frequency. The speakers in row B and C would usually do the same. Because of this decoupling of the two pairs of six speakers is needed.

In order to accomplish this decoupling in the present invention, a series of tubes are arranged behind five of the six speakers in each pair, leaving one open. Each tube in a pair set is a different length and is placed behind a particular speaker in a specified series. The pattern is outlined in FIG. 6. In viewing FIG. 6, the viewer is effectively standing behind the loudspeaker cabinet with the back, bottom and top 104–106 removed and the side and front panels tilted forward to give a perspective view.

Figure 6:
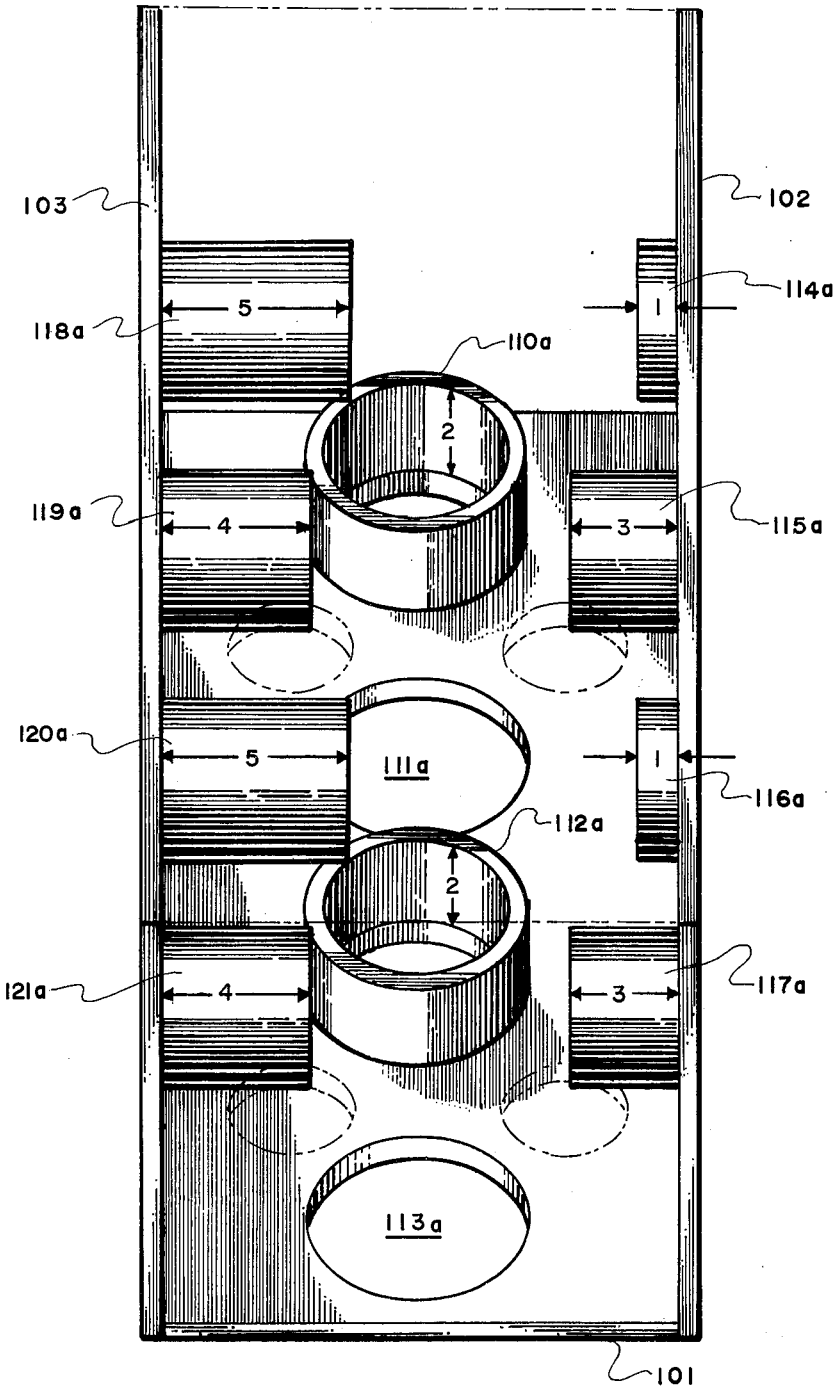
FIG. 6 is a back view of the interior of the lower woofer-tweeter cabinet of FIG. 1, with the top, bottom and back panels removed and the cabinet tilted forwardly, showing the preferred embodiment of the staggered, multi-length decoupling tube system for the woofers of the present invention.

In the preferred embodiment shown in FIG. 6, the relative axial length of the decoupling tubes are illustrated by dimensional number in the figure and are summarized below in tabular form.

| Row | Woofer No. | Tube No. | Relative Length |
|---|---|---|---|
| A | 110 | 110 a | 2 |
| A | 114 | 114 a | 1 |
| A | 118 | 118 a | 5 |
| B | 111 | 111 a | 0 |
| B | 115 | 115 a | 3 |
| B | 119 | 119 a | 4 |
| C | 112 | 112 a | 2 |
| C | 116 | 116 a | 1 |
| C | 120 | 120 a | 5 |
| D | 113 | 113 a | 0 |
| D | 117 | 117 a | 3 |
| D | 121 | 121 a | 4 |

Thus for speaker pair set A, D the tubes run a relative length of 0–1–2–3–4–5, and the same for speaker pair set B, C. In the preferred embodiment shown the actual lengths of the tubes can be the relative length in inches, thus tube 110*a* can be two inches in actual length, etc.

This decoupling arrangement makes each driver operate as though it is enclosed in a separate enclosure. This occurs because the air immediately behind each driver is restricted (loaded) a different way by the various length tubes. Due to the open end of the tube, an individual driver does operate into the entire cabinet. However, when one driver resonates, the other eleven drivers are not in resonance, and therefore the individual resonance effects are minimal. In effect, the system provides a minimal average of all twelve resonant points and not their summation, or as compared to the summation of twelve equal resonant points.

This arrangement allows the design of an enclosure not specifically tuned to a particular frequency, and consequently, subject to none of the problems of such a tuned enclosure. It provides superior linear response in the bass region without a resonant peak. Experiments have also indicated that critical adjustment of tube length can be applied further to balance the interaction of the individual drivers.

The concept of staggering resonances to create an untuned enclosure is important in the present invention and can be applied further to approach a truly linear response. Mechanical resonances can be further staggered by altering the physical makeup of the driver itself. For example, within the same loudspeaker basket, a heavier cone or heavier voice coil will produce a heavier piston, thus lowering the resonant point. The opposite is also true — a lighter cone or lighter voice coil will produce a lighter piston and thus a higher resonant point. By using several drivers with different resonant points, the staggering effect is essentially the same as the internal decoupling effect of the tubes, but the use of the tubes represents the most preferred embodiment and is believed to be in itself inventive in the combination of the present invention.

Rather than use a large woofer in the preferred embodiment, a compromise was chosen between bass output and mid-range transient properties of a smaller woofer. Whereas an eight inch woofer lacks transience, a 4 ½ inch woofer has adequate transience but not enough piston area (effective working cone area) for full bass. A 6 ½ inch woofer was chosen as the preferred embodiment for the woofers 110–121 which are used in multiples. Multiple use allows the addition of smaller woofers to achieve a greater piston area, by acting in unison as one loudspeaker. It is therefore not necessary in the present invention to use the large cone mass traditionally needed for good acoustic impedance, and large bass output.

Besides the bottom unit 100, which contains the low and high frequency arrays, the preferred embodiment of the loudspeaker of the present invention incorporates as well a separate full range, complementary enclosure 200, designed specifically for mid-range use. This separate enclosure also uses a multi-driver array, 210–213, 214–217, and 220–224 (the four mid-range speakers on panel 203 not being visible in the drawings) arranged on three identical panels 201–203, however it is operated full range with an internal low frequency cut-off capacitor to eliminate the very low frequencies. These low frequencies when reproduced simultaneously with higher frequencies, produce intermodulation and Doppler distortion because of the large cone excursions required. Because the unit is not required to produce bass transients, the cone size of the drivers is reduced to for example 4 ½ inches to improve the midband transient response. The cabinet size is also reduced to increase the cabinet loading on the drivers.

By lightening the cones, increasing cabinet loading, and eliminating the low frequencies, the array 210+ will excell in mid-range transience. This is precisely where the lower unit 100 will have its poorest response, as the woofers 110–121 are operating close to their upper limit and the tweeters at their lowest limit. Unlike all other louspeakers, the upper unit 200 is not crossed over at each end of the band. The nature of its design causes its crossover effect. By doing this, the present invention has eliminated an extra crossover point and greatly improved the overall appearance of the crossover point in the lower unit 100.

Being a multi-driver array, the upper unit 200 is also subject to the previously discussed staggering principles, but for somewhat different reasons. As the upper unit 200 is operated above its resonant point, it is not necessary for internal anti-resonant decoupling. However, by altering the weight of the pistons within a unit, the linear midband response is greatly improved. This occurs because each individual driver will operate more efficiently and accurately at one particular frequency, while the remaining drivers each have their ideal frequency within the band. They all work in unison, but each driver complements the other.

The upper unit 200 can be provided in four basic models comprising 6, 12, 18 or 24 driver arrays which offer acoustic and economic flexibility, the 12 driver array being illustrated in FIG. 1. Acoustic performance is improved several ways, as the number of drivers is increased. Among those are reduced distortion, better acoustic impedance to the surrounding air, better dispersion, greater power handling capacity and more possible staggering alternatives.

The loudspeaker of the present invention was specifically designed to be placed in a corner with the front panel 101, 201 facing outwardly with the back panel 104, 204 facing the apex of the wall corner. By doing this, one is able to consistently control its acoustic environment and greatly improve the final overall sound product. Although the combined effect of the cabinet construction and its placement in the corner offers several distinct advantages, the design does not require the cabinet being placed in the corner. It retains its excellent acoustic properties regardless of placement, however the corner represents its ideal environment.

The following is a summary of the external acoustic operation of the loudspeaker of the present invention in its ideal environment. Because of the limited amount of air, partially trapped between sides 102, 202 and 103, 203 and their respective walls, the woofers 114–117 and 118–121 on sides 102 and 103, respectively, are tightly coupled to the area on each side of the loudspeaker. It is this tight coupling and the capacity of the remaining front woofers 110–113, which creates what might be called a "phantom woofer". It is so called because the air immediately surrounding the cabinet is so well coupled that it senses that it is being acted upon by a woofer extending completely around the three radiating sides and the entire height of the cabinet. It is this effect which provides the excellent bass coupling to the room without large cone area and mass conventionally required. The coupling effect also provides other benefits as well. As can be easily visualized, the walls of the corner also provide the reflecting surfaces needed to achieve the natural reverberation of live music. The sound radiating from sides 102, 202 and 103, 203 travels indirectly to the listener, first being reflected off the walls in the corner. It is this effect, as well, which provides the expanded panorama of the loudspeaker of the present invention. But because of the limited amount of area the air is free to travel in, the loudspeaker still retains excellent directionality.

Figure 11:
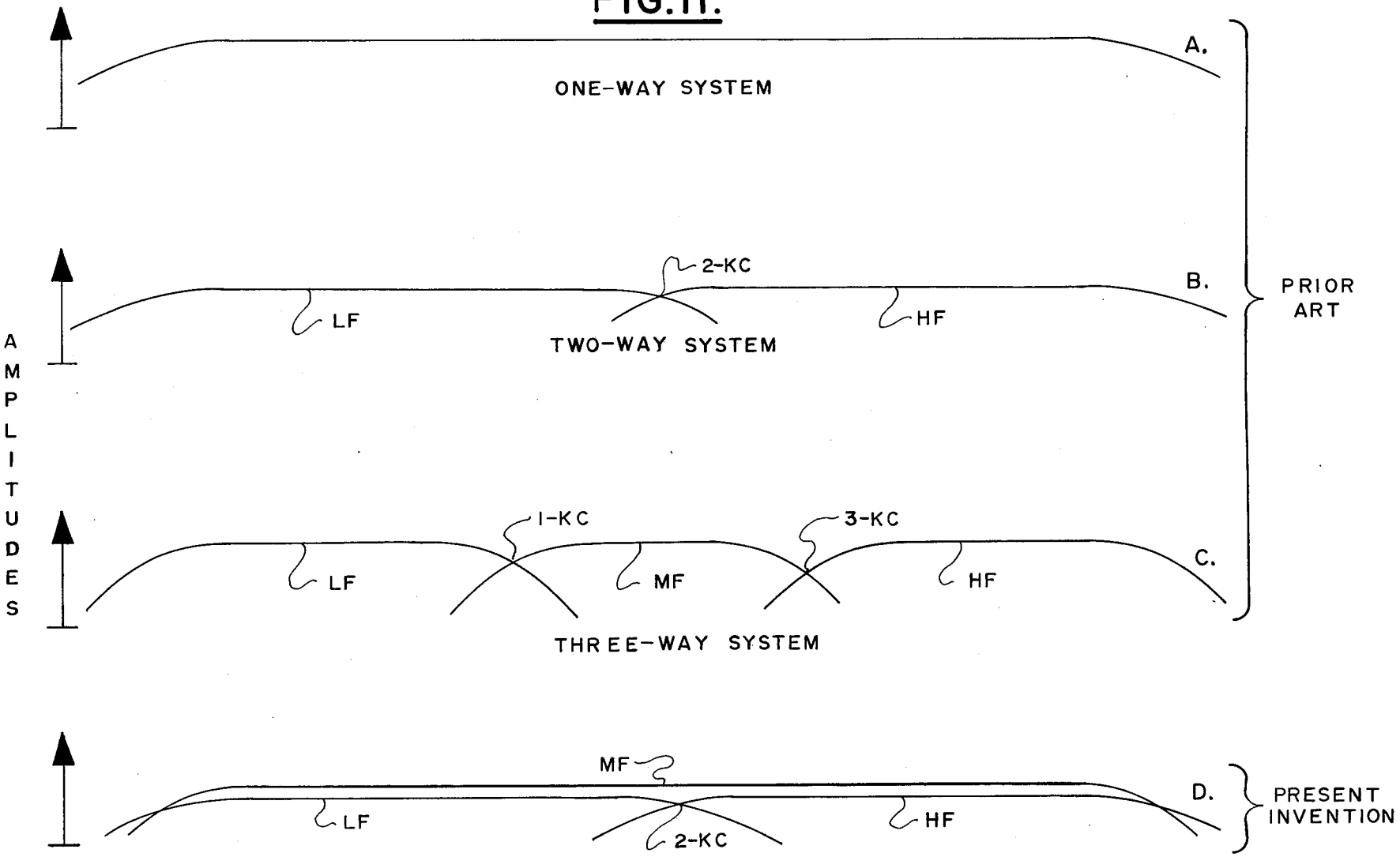
FIG. 11 is a graphical illustration contrasting the complementary speaker out-put ranges of the 3-way system of the present invention with that of the other speaker systems of the prior art.

The mid-range speakers of the upper unit 200 complement the woofers and tweeters in the lower unit 100, in a way substantially different from the prior art and giving the present invention very substantial advantages. These differences are graphically illustrated in FIG. 11. With reference to FIG. 11:

Graph A represents a single, or multiple drivers, operating over the entire frequency spectrum.

Graph B represents a 2-way system which applies the audio spectrum in bands to two different types of drivers, to wit, woofers (low frequency) and tweeters (high frequency).

Graph C represents a 3-way system incorporating an additional mid-range driver and corresponding crossover point.

Graph D represents the present invention which utilizes a three way technique with only one crossover point. The mid-range unit is rugged enough to operate full range and complements the bottom unit 100 at its most irregular point. The mid-range unit eliminates a crossover point and greatly improves the acoustic appearance of the existing crossover point in the bottom unit 100.

The preferred embodiment of the loudspeaker of the present invention incorporates a unique high frequency array which exhibits excellent polar and dispersion characteristics, without suffering from inherent phase problems. This is accomplished through the use of a soft, hemi-spherical dome transducer which radiates 180° on a plane. However, as can be visualized from FIG. 1, the array radiates from three sides 101–103, providing dispersion of over 270°. And, because of the arrangement of the tweeters, the loudspeaker suffers from minimal phase disturbances. It is the semi-omnidirectional characteristics of the cabinet which also lessen the unit's susceptibility to acoustic feedback, as the source device is not coupled to one, but several drivers, each being a different distance from the source.

Once again, it is the excellent acoustic design of the loudspeaker which makes all of these advantages possible, and not the physical placement of the speaker. The unit will provide superior performance, regardless of placement.

Generally speaking, in a loudspeaker system the terminal strip and crossover components act as an interface between the drive (amplifier) and the load (driver). The preferred embodiment of the loudspeaker of the present invention is designed so that the loudspeaker has versatility and can be used without any modifications, in any possible type of application that might be encountered.

There are several different ways, generally speaking, to apply a drive to a loudspeaker. Each has its own advantages and disadvantages. The following is a summary of these methods and a demonstration of why the preferred embodiment of the loudspeaker system of the present invention achieves versatility in its interface. They are arranged from simple to complex.

1. A single ended amplifier, driving a brute force filter, placed between the drivers and amplifier is the most common type of crossover system. It is so because it requires only one amplifier and no type of specialized electronics to cause the crossover to occur. Its advantage is therefore one of economics, and it operates in the following manner: The full range of musical signals for a particular channel is amplified through a single channel of a power amplifier unit and is delivered to the rear terminal of the loudspeaker unit. The signal is then divided according to frequency, with the low frequencies being sent to the woofers and the high frequencies being delivered to the tweeters. This is accomplished by placing an inductor in series with the woofer, and capacitor in series with the tweeter. The effects of the inductor and the capacitor in relation to speaker impedance are used to cause the crossover. As this method does offer the advantage of simplicity, and thus a reduction in cost, it does cause some extreme disadvantages. First, the power amplifier is driven full range, thereby setting up a condition that leads to generation of intermodulation distortion. This is due to the interaction of the highest and lowest frequencies mixing in the same amplifier. Also, due to the fact that the low frequencies consume the largest amount of the voltage swing of the amplifier, an amplifier of extremely high power output is required to reproduce music of very wide range at a realistic listening level. A second set of problems arises at the crossover itself. First is the phase shift which occurs as the natural reaction of the inductor and capacitor to different frequencies. These phase shifts cause irregularities in both the polar and phase responses of the drivers, that is, at the crossover point. The low and high frequency drivers will be playing the same signal, but the phase shift in the active components will cause them to be playing the signals at different times. This causes cancellation or aggravation of a particular frequency, dependent upon the amount of the phase shift. The second half of that same problem is that the crossover components, because of their particular characteristics, make the amplifier feel a reactive, rather than a resistive load. This causes the problem of ringing in the amplifier bringing the amplifier near oscillation. All of these disadvantages each play a small part in the degradation of the final sound product.

2. Dual ended amplification with crossover being accomplished electronically before the amplifiers is accomplished as follows: The signal is processed full range in the pre-amplifier stages, but in an active circuit placed directly before the power amplifiers, the signal is divided according to frequency content, and is sent individually to different amplifiers, which in turn drive the different drivers. This offers several advantages. There is no intermodulation distortion in the amplifiers due to the fact that the amplifiers are not playing the same signal. Secondly, it is not necessary to use an extremely large amplifier to avoid constant premature clipping. There are no phase or polar irregularities due to the fact that there is no brute force crossover, and consequently, minimal phase shift. The disadvantage to this method is that there is an extra amplifier and an electronic crossover network required. The second disadvantage, which is not the case with the preferred embodiment of the loudspeaker of the present invention, is that internal modification is required to separate the transducer channels and remove the brute force crossover components. This is true in most other loudspeakers.

3. Dual ended bridged amplification with crossover being accomplished electronically before the power amplifiers is the most sophisticated type of amplification. It is essentially the same as that described in part 2 supra, except that the grounds of the loudspeakers need to be separated because there is no actual ground (both terminals are hot). It takes advantage of the 4× power factor of bridging. Its disadvantages are the same as type 2 supra, plus it also needs to have its grounds separated.

Figure 7:
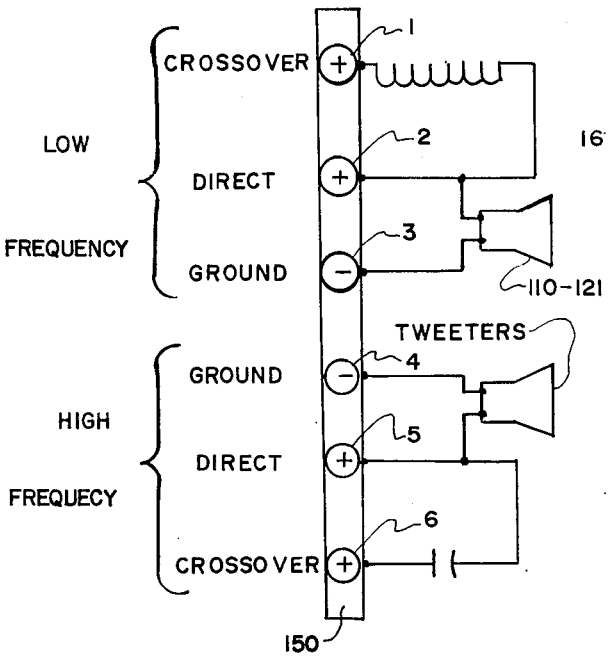
Figure 8:
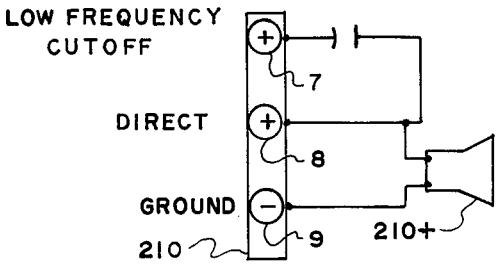
FIG. 8 is a generalized, schematic illustration of the preferred embodiment of the speaker hook-up of the present invention for the upper, mid-range speaker array.

The criteria for the design of the interface of the loudspeaker of the present invention was that it would have to be as simple as possible, yet be able to be used in any possible type of amplification that might be encountered. This is accomplished as follows: On the bottom unit 100 a six-terminal strip 150 is used, and on the upper unit 200 a three-terminal strip 250 is used; not FIGS. 7 and 8.

Figures 7A, 7B, 7C:
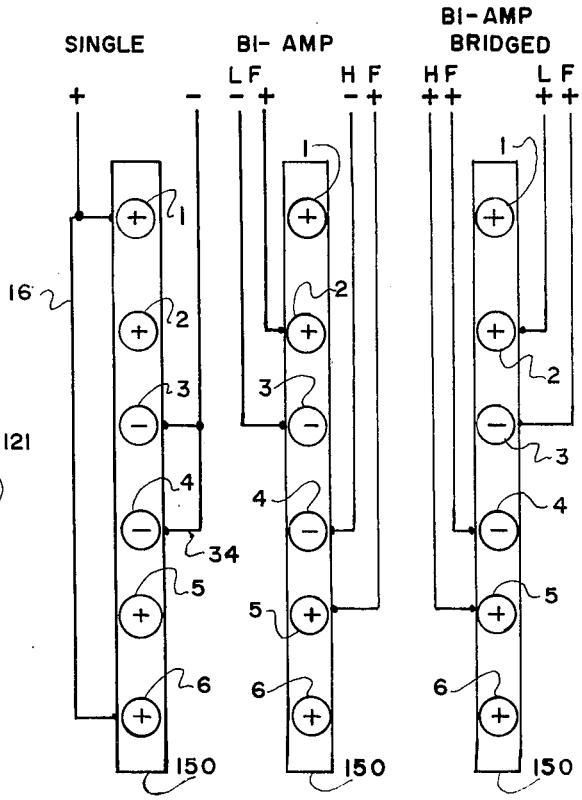
FIGS. 7A–7C are schematic illustrations of the external terminal strip of FIG. 7 but further showing the external variations thereof for various types of amplification systems.

Pins 3 and 4 are the grounds for strip 150 and are tied together by jumper 34 for brute force use, note FIG. 7A. Pins 1 and 6 are the positive terminals of strip 150 to the respective driver components, and are also shorted by jumper 16 for single amplifier use. The loudspeakers can be and preferably are delivered to the user with these pins 3, 4 and 1, 6 jumped externally.

If any of the other types of drivers are to be used, these can be accomplished without any internal modification. By removing the jumper 16 from pins 1 and 6, the positive terminals to both driver arrays have been separated. By hooking up the positive outputs from bi-amplifiers to pins 2 and 5, note FIGS. 7B and 7C, the loudspeaker has been entered without going through the inductor and capacitor crossover components. By removing the jumper 34 from pins 3 and 4 the grounds have been separated.

The system of the present invention can thus be used with any type of amplification, without any type of internal modification, merely be re-adjustment or elimination of the jumper cables 16, 34.

Thus, as should be clear from the foregoing, the lower and upper units 100, 200 are basically mainframes each consisting of a top 106, 206, back 104,204 and botton 105, 205, making the "outside C", as viewed from the side. The remaining three sides 101–103, 201–203 are completed by installing various speaker array panels having the desired number of speakers similarly arrayed about the three operative sides. However, although the size (particularly the height) of the panels 201–203 of the upper, mid-range unit 200 can vary according to the number of speakers 200+ used, the size of the panels 101–103 preferably remain the same, and vary only in speaker compliment.

Because the alternate arrays for the lower unit 100 having less than the number of speakers illustrated in FIG. 1 are preferably designed asymmetrically, they offer the added advantage of an alternate loading scheme. For example, if only a total of six woofers were used rather than the twelve illustrated, they would be placed at the analogous locations of rows A and B; or if only three woofers were to be used they would be placed at the analogous locations of row A. As can be visualized, the cabinet 100 may then be placed either up or down having the drivers either toward the ceiling or floor. This will effectively decrease or increase the bass coupling, depending on the desired effect.

The loudspeaker system of the present invention, because of its high efficiency, excellent acoustic coupling, high power-handling capacity and low distortion, is ideally suited for commercial as well as consumer high fidelity use. To accomodate these characteristics, a unique commercial packaging arrangement can be employed.

Figure 9:
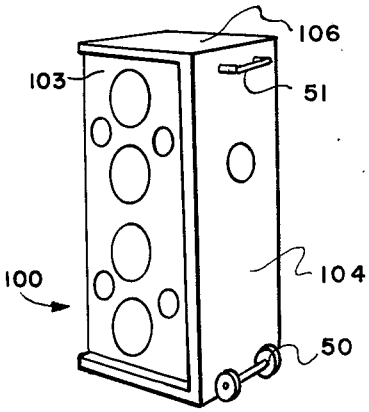
FIG. 9 is a top perspective view of the back of the lower speaker unit showing suitable rollers and handle on the back of the unit for easy mobility and manipulation for a commercial embodiment of the preferred embodiment of the system of the present invention.
Figure 10:
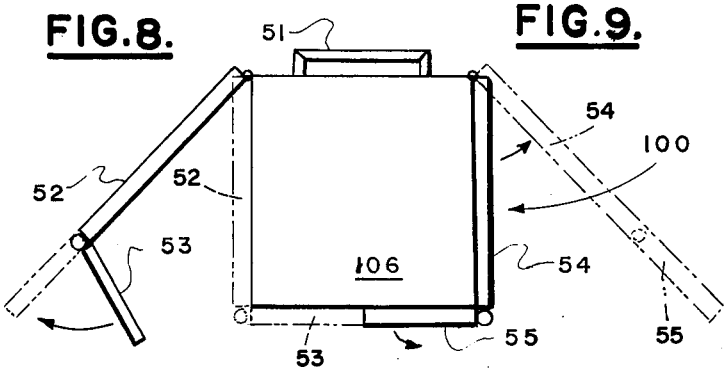

Such a commercial version, as illustrated in FIGS. 9 and 10, can include bottom wheels or rollers 50 and handles 51 for easy mobility and manipulation. And, because commercial applications are not usually suitable environments, lower unit 100 of the loudspeaker can incorporate a protective case made up of outer, wooden wall sections 52, 53 and 54, 55. The wall sections 52, 53 (like 54, 55) are hinged together, with section 52 (like 54) hinged to the back edge of the cabinet. The case opens and locks into place with each wall 52, 53 and 54, 55 forming a straight, reflective surface forming a 45° angle with panels 102 and 103, respectively, of the cabinet to provide the cabinet with its own built-in "corner". So even when taken outdoors, the cabinet can be provided with its ideal corner environment. When closed the opposing wall sections 52 and 54 can be latched shut together.

The upper unit 200, because of its design, does not offer alternate loading schemes. However, as this unit may also be somewhat large, it can also be provided with rollers and handles. It can incorporate as well the same unique protective case described above, which when open also provides a built-in corner for the unit.

For appearance or aesthetic purposes, speaker or audio grill cloth of course can be used to cover the exposed speaker panels 101–103, 201–203 illustrated in FIG. 1.

The above are, of course, merely exemplary of the possible changes or variations. Because many varying and different embodiments may be made within the scope of the inventive concept herein taught and because many modifications may be made in the embodiments herein detailed in accordance with the descriptive requirements of the law, it is understood that the details herein are to be interpreted as illustrative and not in a limiting sense.

What is claimed as invention is:

1. A high fidelity loudspeaker system comprising:

an enclosed airtight speaker cabinet having three operative panels each having openings therein into the interior of said enclosure and speakers located within said openings closing them off with the backs of said speakers being exposed to said interior through said openings, at least some of said speakers having tubes surrounding them on their back, interior sides extending into said interior, the lengths of at least some of said tubes being substantially different, said tubes serving as anti-resonance decoupling means for said speakers.

2. The high fidelity loudspeaker system of claim 1 wherein there is included at least two horizontal rows of said speakers, at least two like speakers on each panel, at least all of said like speakers except one having said tubes, no one of which has the same axial length.

3. The high fidelity loudspeaker system of claim 2 in which said tubes at least generally follow the relative axial length ratio of 0-1-2-3-4-5.

4. The high fidelity loudspeaker system of claim 3 wherein a first one of said rows includes the ratios of 0-3-4 and the other row includes the ratios of 2-1-5.

5. The high fidelity loudspeaker system of claim 4 wherein the relative ratio length of the tubes on a panel occupies the same relative position in said two ratios, the tubes on one panel having the ratios "0" and "2", the tubes on second panel having the ratios of "3" and "1", and the tubes on the last panel having the ratios of "4" and "5".

6. The high fidelity loudspeaker system of claim 1 wherein said three operative three panels are orthogonally located with respect to one another and there is further included orthogonally located back, top and bottom panels which are completely closed and have no operative speaker elements therein, all of said panels together forming a complete enclosure.

7. A high fidelity loudspeaker system comprising:

a vertically extended speaker column having three, vertical, operative speaker panels with speakers therein and a fourth back panel; and an outer, built-in protective casing for said three panels comprising two hinged wall sections each hinged to opposite side edges of said back panel which when closed cover all three panels and when open form two diagonally disposed sound reflecting surfaces, providing the reflective acoustic effect of said speaker column being located in a corner.

8. A high fidelity loudspeaker system comprising:

a first air-tight, closed cabinet having an array of woofer and tweeter speakers contained therein for reproducing low and high frequencies, respectively; and a second, air-tight, closed but complementary cabinet physically separate from said first cabinet having an array of mid-range speakers contained therein for reproducing at least the mid-range frequencies, said two cabinets placeable together in juxtaposition one on top of the other, outside the enclosure of the other; the speakers in both said cabinets being driven to reproduce complementary sounds.

9. The high fidelity loudspeaker system of claim 8 wherein said cabinets each are box-shaped having a square cross-section, three of the vertical panels forming each said cabinets having speakers therein, the other vertical panel and the top and bottom panels having no operative speakers therein, said second, complementary cabinet being located on top of said first cabinet.

10. The high fidelity loudspeaker system of claim 9 wherein the speaker array on each operative panel in each cabinet are substantially identical and arrayed on each said operative panel in an identical pattern.

11. A high fidelity loudspeaker system comprising: an array of woofer, mid-range and tweeter speakers, having low, medium, and high frequency response respectively, wherein said woofers and tweeters include a single frequency cross-over electronic circuit means between them for feeding the low frequency signals only to said woofers and the high frequency signals only to said tweeters, respectively, for the driving thereof, and wherein said mid-range speakers include no frequency cross-over means between them and said woofers and wherein tweeters, said mid-range speakers being driven over at least substantially all of the full spectrum of audio frequencies, said woofers, tweeters and mid-range speakers being generally simultaneously driven to reproduce complementary sounds.

* * * * *